US008439323B1

(12) United States Patent
Bae et al.

(10) Patent No.: US 8,439,323 B1
(45) Date of Patent: May 14, 2013

(54) DISPLAY HANGING SYSTEM

(75) Inventors: Hyon S. Bae, Oakland, CA (US); Gary Curtis Gehrke, San Jose, CA (US); William Richardson Jones, III, San Francisco, CA (US); Ann Laurent Torres, San Francisco, CA (US)

(73) Assignee: Ka-Chunk LLC, Palo Alto, CA (US)

( * ) Notice: Subject to any disclaimer, the term of this patent is extended or adjusted under 35 U.S.C. 154(b) by 0 days.

(21) Appl. No.: 13/031,177

(22) Filed: Feb. 18, 2011

Related U.S. Application Data

(60) Provisional application No. 61/305,919, filed on Feb. 18, 2010.

(51) Int. Cl.
*A47H 1/10* (2006.01)

(52) U.S. Cl.
USPC ..... 248/328; 248/317; 248/323; 248/327; 248/489

(58) Field of Classification Search ..... 248/489, 248/492, 493, 494, 475.1, 476, 317, 323, 248/327, 328
See application file for complete search history.

(56) References Cited

U.S. PATENT DOCUMENTS

| | | | | |
|---|---|---|---|---|
| 383,873 | A * | 6/1888 | Fay | 248/495 |
| 2,697,572 | A * | 12/1954 | Pfankuch | 248/495 |
| 5,584,462 | A * | 12/1996 | Reese | 248/477 |
| 6,119,999 | A * | 9/2000 | Fleishman | 248/489 |
| 6,820,853 | B1 * | 11/2004 | DuBarry | 248/489 |
| 7,523,908 | B2 * | 4/2009 | Kozak et al. | 248/307 |

* cited by examiner

*Primary Examiner* — Amy J Sterling
(74) *Attorney, Agent, or Firm* — Leland Wiesner; Wiesner & Associates

(57) ABSTRACT

Aspects of the present invention include an apparatus for hanging a display device. In one implementation, the apparatus for hanging a display device, includes an upper mount plate suitable for attaching to a flat surface having a left cable extending downward and approximately normal to a longitudinal axis of the upper mount plate and a right cable extending downward and approximately normal to the longitudinal axis of the upper mount plate. In addition, the apparatus further includes a lower mount plate attachable to a back portion of a display device. The left cable is coupled to at least two approximately vertically aligned receiving points on a left portion of the lower mount plate. The right cable is coupled to at least two approximately vertically aligned receiving points on a right portion of the lower mount plate.

3 Claims, 9 Drawing Sheets

DISPLAY HANGING SYSTEM

(1) CROSS REFERENCE TO RELATED APPLICATIONS

This application relates to and claims priority to U.S. Provisional Application No. 61/305,919 filed Feb. 18, 2010 to Bae et al. entitled "DISPLAY HANGING METHOD AND SYSTEM", which is incorporated herein by reference in the entirety for all purposes.

BACKGROUND (2) Technical Field

Aspects of the present invention relate to mounting devices for displays.

(3) Description of the Related Art

With the advent of flat panel display technology, display devices are used in an ever increasing range of commercial and home applications. In a home entertainment system, a display device may be held upright by a pedestal or hung on a wall with a wall mount flanked by speakers and other electronics. The pedestal sits on the mantle of a fireplace or other supportive surface and attaches with screws to mount points on the back of the display device. Typically, the mount points on the display device are arranged according to a Flat Display Mounting Interface (FDMI) also known as a Video Electronics Standards Association (VESA) mount. In comparison, the wall mount bracket allows the display device to be hung over the fireplace or any other flat wall surface. The conventional wall mount systems have a plate on the end of a swing arm that attaches to the display device also using the VESA mount standard. Most people prefer the wall mount bracket as it can be mounted in most locations on any flat wall surface.

Display devices in a commercial setting use similar wall mount systems but have even more demanding requirements. In restaurants, businesses, retail stores and other public places, large display devices may be located against a wall in a room with very high ceilings so that a large number of people can view. Often the display device needs to be tilted downwards to increase the viewing angle to people sitting or standing below the display. Clearly, it is important for these devices to be securely mounted so they do not potentially fall and injure the patrons below.

Conventional wall mount devices are heavy steel construction with a plate that attaches to the wall and another plate that attaches to the back of the display device. A swing arm or other mechanism between the two plates allows the display device to be positioned. Typically a person pulls on the display device causing the swing arm to extend and allow for adjustments to be made. Unfortunately, the person may pull the display device too hard causing the wall mount device to dislodge from the wall and fall out. In some cases, pulling on some display devices that are thin or fragile may cause undue strain on the screen surface causing them to distort and/or crack.

Installing the display device and wall mount system is also an arduous task. First, the proper wall mount device must be selected having the proper corresponding compatible VESA mount holes as well as the appropriate weight capacity rating. Typical display devices have one set of four (4) VESA mount holes in a rectangular arrangement of 100 mm×100 mm, 200 mm×200 mm, 300 mm×300 mm, 400 mm×400 mm, 600 mm×200 mm, 600 mm×400 mm, 800 mm×400 mm and others. While larger and heavier display devices generally use the larger mount point dimensions, it is up to the manufacturer to make this determination. As a result, a wall mount rated to hold the weight of the display may be incompatible with the mount point dimensions of the display. The wall mount may also not work if a plate for the display device has more common VESA mounts and the manufacturer selects a less common dimension such as 600 mm×200 mm.

To secure the display device, the conventional wall mount device should be installed on at least one and possibly two studs within a wall. This is hard to do when the wall mounts have smaller mounting plates centered directly behind the display. As a result, many installers use drywall screws and other less than optimal fastening mechanisms to install the wall mount systems. Often these fastener mechanisms are susceptible to stripping and loosening over time especially if the display device is pulled on and frequently adjusted.

Conventional wall mounts are also difficult to adjust once they are screwed into the wall and secured. A display device that lists to one side or the other generally needs to be completely removed and reinstalled. This requires new holes to be drilled into the wall and another attempt at the installation. Because of their weight and/or size, at least two people are recommended to lift the display device off the wall and back onto the wall once the wall mount is reattached. Even when a bubble leveler indicates the underlying wall mount is level, the display device may still continue to appear crooked due to sloping ceilings, walls or other visual distractions near the display device.

SUMMARY

Aspects of the present invention include apparatus for hanging a display device. In one implementation, the apparatus for hanging a display device, includes an upper mount plate suitable for attaching to a flat surface having a left cable extending downward and approximately normal to a longitudinal axis of the upper mount plate and a right cable extending downward and approximately normal to the longitudinal axis of the upper mount plate. In addition, the apparatus further includes a lower mount plate attachable to a back portion of a display device. The left cable is coupled to at least two approximately vertically aligned receiving points on a left portion of the lower mount plate. The right cable is coupled to at least two approximately vertically aligned receiving points on a right portion of the lower mount plate.

DETAILED DESCRIPTION OF THE INVENTION

Figure 1:
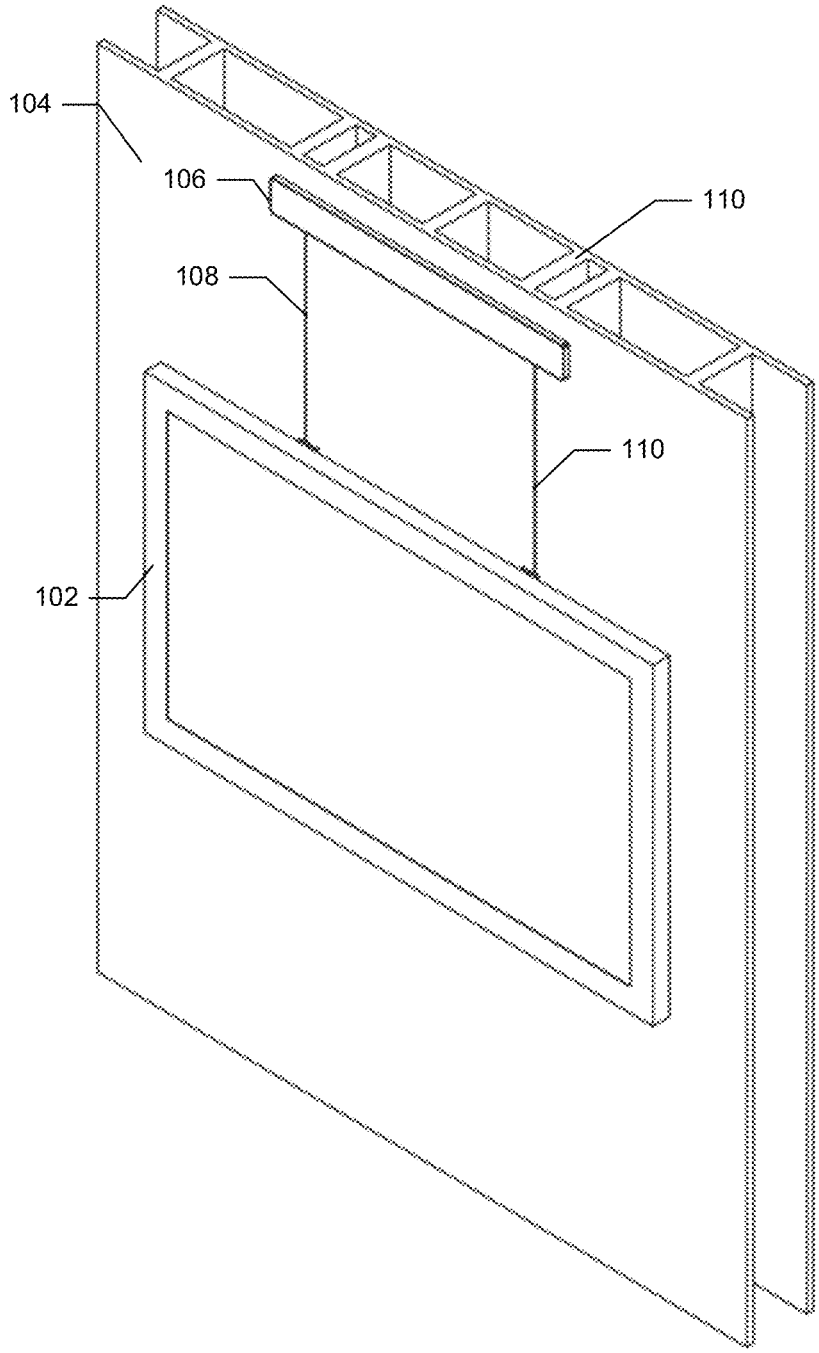
FIG. 1 is a front perspective view illustrating a display hanging system attached to a display device in accordance with aspects of the present invention.

In the following detailed description, for purposes of explanation, numerous specific details are set forth to provide a thorough understanding of the various embodiments of the present invention. Those of ordinary skill in the art will realize that these various embodiments of the present invention are illustrative only and are not intended to be limiting in any way. Other embodiments of the present invention will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual implementation, numerous implementation-specific decisions may be required to achieve specific design objectives. These design objectives will vary from one implementation to another and from one developer to another. Moreover, it will be appreciated that such a development effort might be complex and time-consuming but would nevertheless be a routine engineering undertaking for those of ordinary skill in the art having the benefit of this disclosure.

Aspects of the present invention provide one or more of the following advantages. A display hanging system of the present invention allows a display device to be repositioned without remounting. To raise the display device, a right cable and a left cable holding the display device are retracted. Lowering the display device is achieved by extending both the right and left cables. If the display device appears tilted or uneven, the right or left cable may be independently adjusted until the display device appears level.

A display device using the hanging system design of the present invention requires no heavy lifting and may be repositioned by one person. Instead of touching the display device, a user turns an adjustment rod located in the upper mount plate with a key, small wrench or even a cordless drill. Adjustment mechanisms in the upper mount plate respond by gently raising or lowering the display device into the desired position. This not only makes it easier to reposition the display device but also protects the display device from excessive forces that might crack or compromise a fragile screen and associated electronics.

The display hanging system of the present invention is compatible with display devices having a wide range of weights and sizes. First, a wide upper mount plate may be used for display devices having different sizes and weights. The wide upper mount plate makes it easier to locate and attach the hanging system to studs in conventionally constructed walls. High strength cabling extending downward to the display device holds heavier devices and distributes the downward forces more evenly across a larger area. Second, an adjustable lower mount plate attached to the display device can be slidably adjusted to match the specific mount hole dimensions as needed. This is makes the overall hanging system easier to use as it is compatible with both the common and less common mount hole dimensions used on display devices.

Referring to FIG. 1, a front perspective view illustrates a display hanging system attached to a display device in accordance with aspects of the present invention. This particular implementation of display hanging system in FIG. 1 includes an upper mount plate 106, a left cable 108, a right cable 110 and a display device 102. As shown, the upper mount plate is suitable for attaching to a flat surface and has a left cable and a right cable extending downward and approximately normal to a longitudinal axis of the upper mount plate. In this example, upper mount plate 106 is mounted against a wall 104 created using conventional construction methods including studs 110 and other structures. Accordingly, the upper mount plate 106 may be attached to one or more studs 110 in the wall to ensure the upper mount plate 106 is securely attached and can readily support the display device 102. In another implementation, it is contemplated that upper mount plate 106 could be modified and readily attached on a flat ceiling area rather than a wall provided sufficient underlying studs and other structures are available for mounting.

Figure 2:
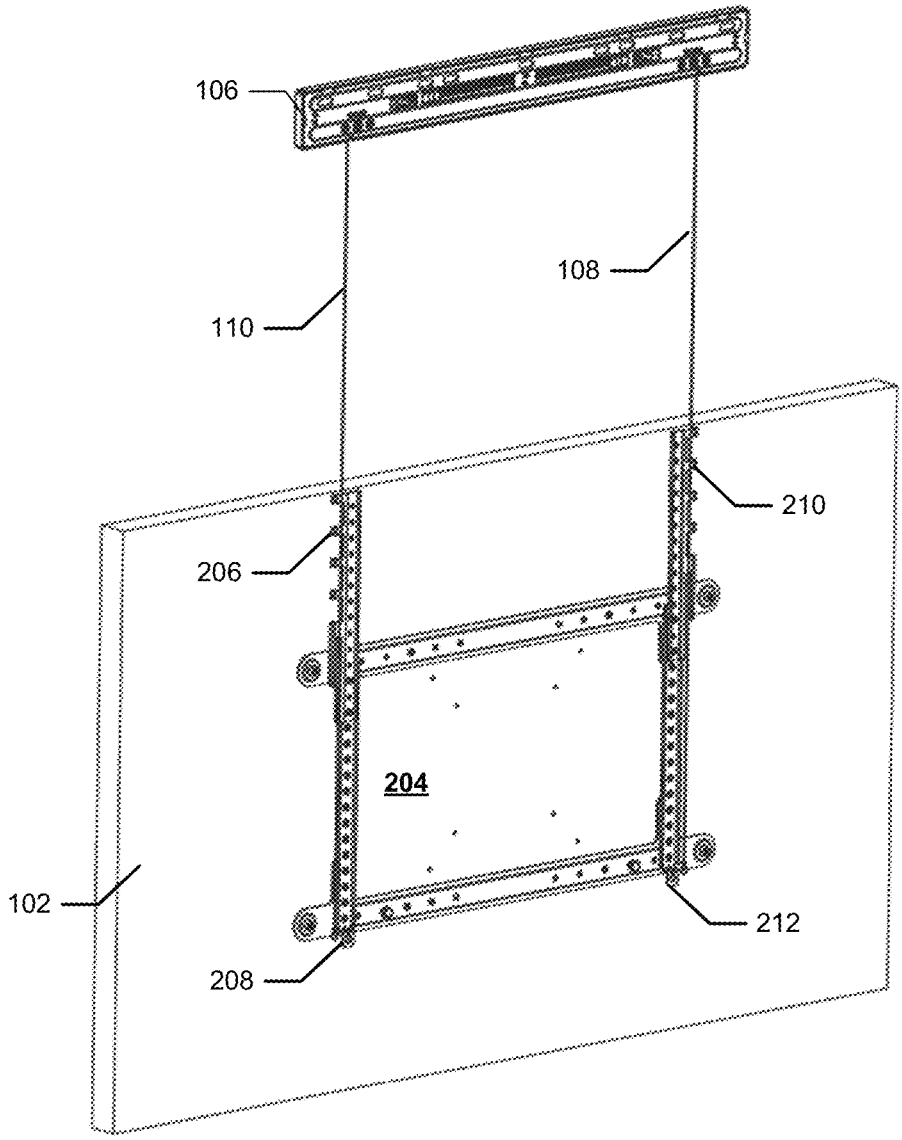
FIG. 2. illustrates a backside perspective view of a display hanging system designed in accordance with the present invention and attached to a display device.

FIG. 2 illustrates a backside perspective view of display hanging system designed in accordance with the present invention and attached to display device 102. From this perspective, it can be seen that a lower mount plate 204 is attached to a back portion of the display device 102. Lower mount plate 204 has at least two approximately vertically aligned receiving points for the left cable 108 on a left portion of the lower mount plate 204 and at least two approximately vertically aligned receiving points for the right cable 110 on a right portion of the lower mount plate 204. In this example, the left cable 108 extends downward from the upper mount plate 106 with a distal end of the left cable 108 inserted into a lower pivot hole 212. A segment below the proximal end of the left cable 108 passes in front of and rests against a pivot tab 210 approximately vertically aligned above the lower pivot hole 212. Similarly, the right cable 110 extends downward from the upper mount plate 106 with a distal end of the right cable 110 inserted into a lower pivot hole 208. A segment below the proximal end of right cable 110 passes in front of and rests against a pivot tab 206 approximately vertically aligned with the lower pivot hole 208.

Figure 3:
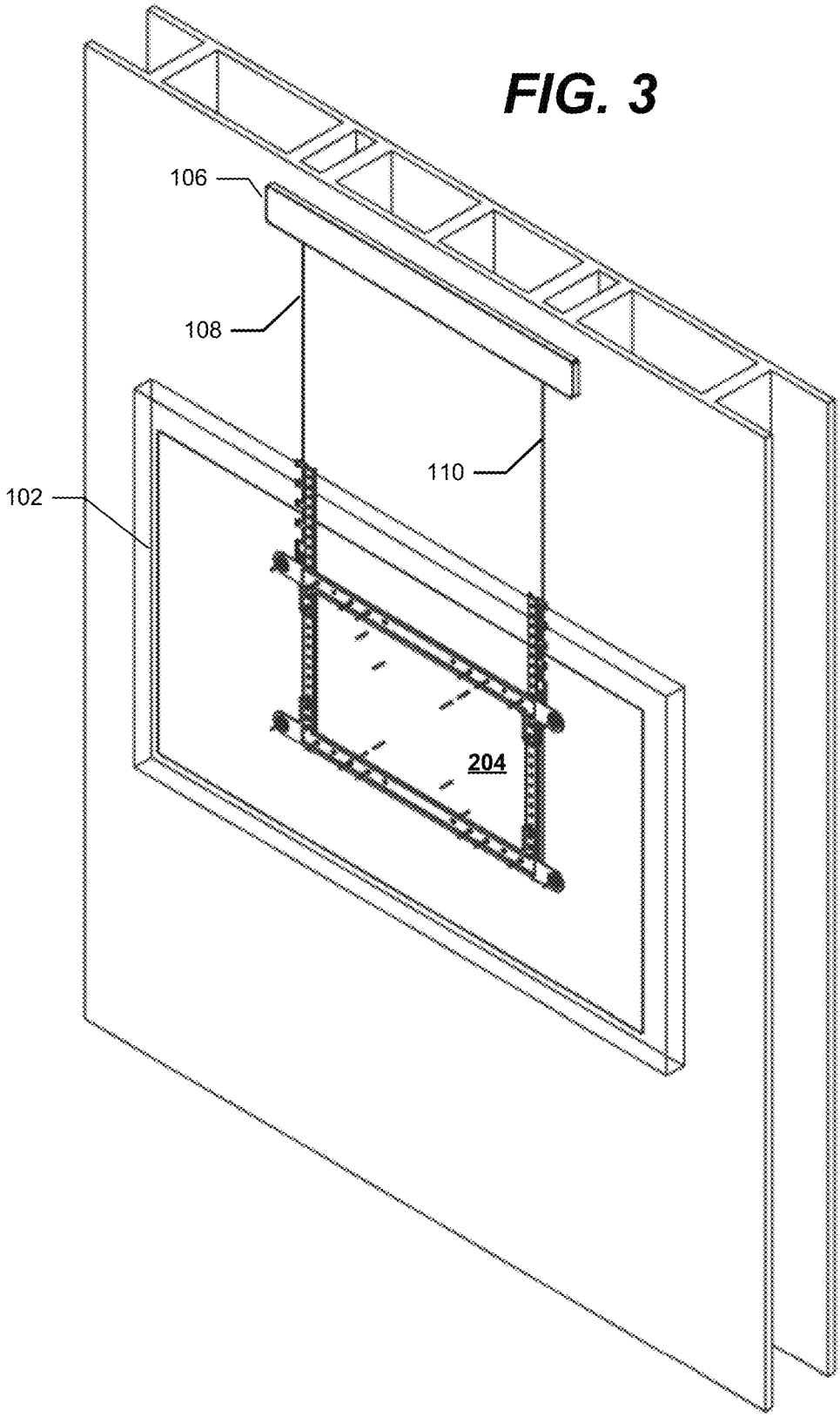
FIG. 3 illustrates a cutaway perspective view of a display hanging system designed in accordance with aspects of the present invention.

FIG. 3 illustrates a cutaway perspective view of a display hanging system designed in accordance with aspects of the present invention. This viewpoint illustrates lower mount plate 204 through the front side of the display device 102 and the screws or fasteners that attach the lower mount plate 204 to the back portion of the display device 102. This also illustrates that lower mount plate 204 has at least two approximately vertically aligned receiving points for the left cable 108 on a left portion of the lower mount plate 204 and at least two approximately vertically aligned receiving points for the right cable 110 on a right portion of the lower mount plate 204.

Figure 4:
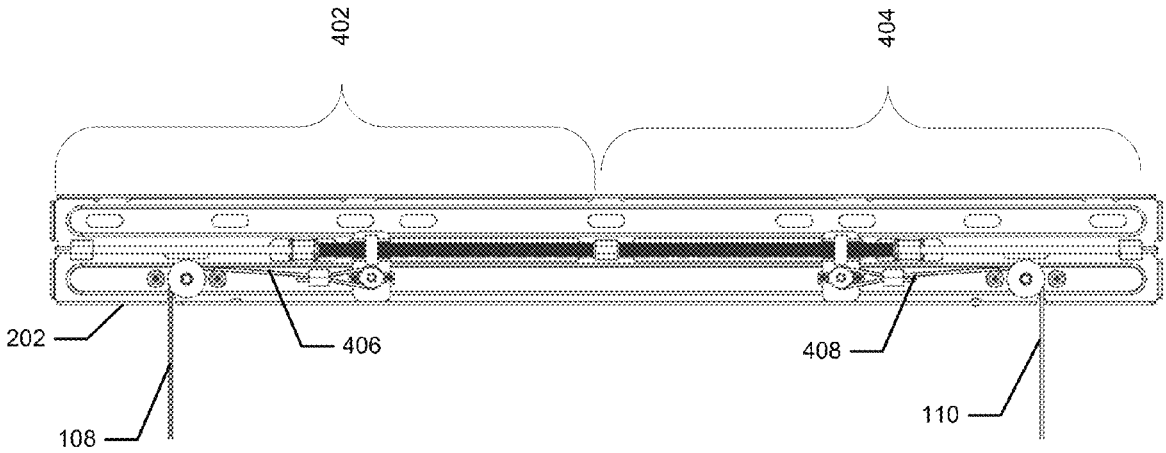
FIG. 4 illustrates a detail view of the upper mount plate without a cover and designed in accordance with one implementation of the present invention.

FIG. 4 illustrates a detail view of the upper mount plate 202 designed in accordance with one implementation of the present invention. In this illustration, a first cable adjustment mechanism 402 is integrated into the upper mount plate 202 and changes the length of the left cable 108 extended downward from the upper mount plate 202. For example, the first cable adjustment mechanism 402 may take up retracted left cable 406 and extend left cable 108. In one implementation, extending left cable 108 may lower the left side of the display device without affecting the length of the right cable 110 extended downward.

Similarly, a second cable adjustment mechanism 404 from FIG. 4 may also be integrated into the upper mount plate 202. This second cable adjustment mechanism 404 likewise may take up retracted right cable 408 and extend right cable 110. In one implementation, extending right cable 110 may lower the right side of the display device without affecting the length of the left cable 108 extended downward. Accordingly, this implementation of the present invention allows first cable adjustment mechanism 402 and second cable adjustment mechanism 404 to operate independently providing for finer control over the position of the display device hanging below.

In an alternate implementation, first cable adjustment mechanism 402 and second cable adjustment mechanism 404 may also operate together in controlling the length of left cable 108 and right cable 110. For example, this would allow both sides of a display device to be raised or lowered together. It is contemplated that this may be implemented using a single shaft connecting the first cable adjustment mechanism 402 and second cable adjustment mechanism 404 together. In yet another implementation, a lockable shaft between first cable adjustment mechanism 402 and second cable adjustment mechanism 404 would allow the first cable adjustment mechanism 402 and second cable adjustment mechanism 404 to be selectively operated independently or together depending on the particular requirements.

Figure 5:
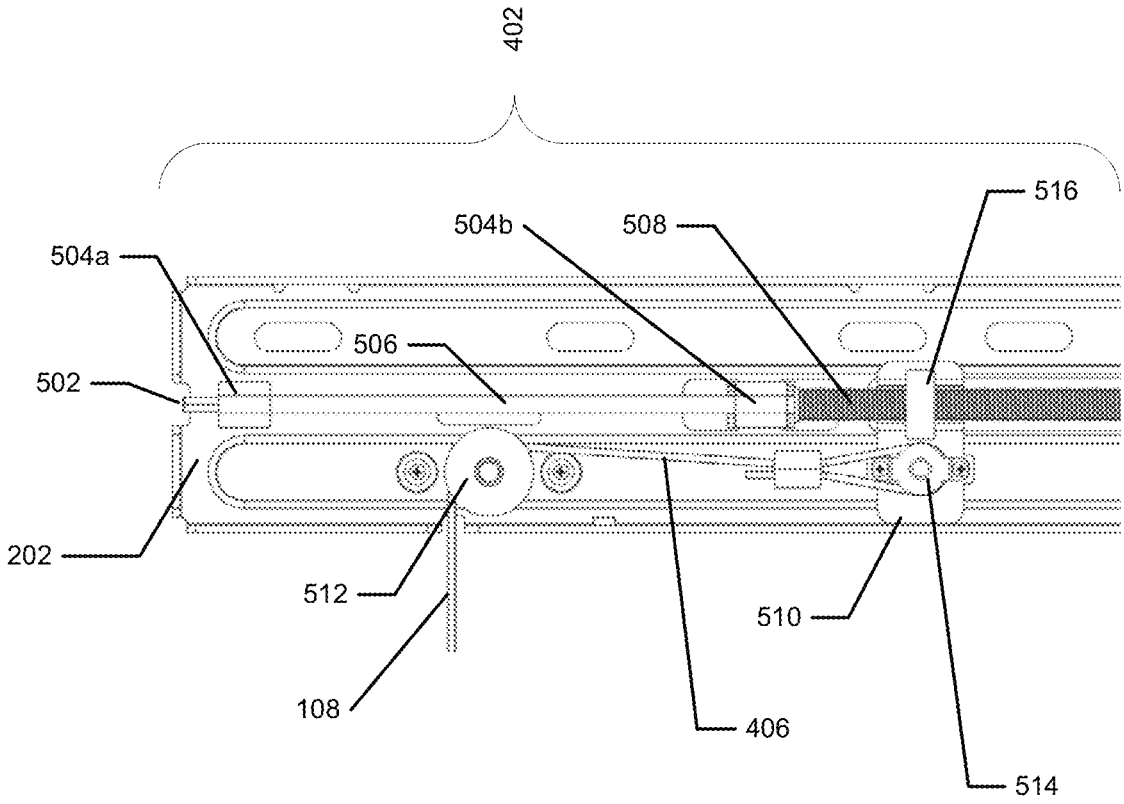
FIG. 5 illustrates a detailed view of a cable adjustment mechanism integrated into an upper mount plate in accordance with one implementation of the present invention.

FIG. 5 illustrates a detailed view of the first cable adjustment mechanism 402 integrated into upper mount plate 202. It is contemplated that second cable adjustment mechanism 404 is similarly designed with suitable modifications allowing it to operate on right cable 110 as it is extended from the right side of upper mount plate 202 (not shown in FIG. 5).

In one implementation, first cable adjustment mechanism 402 includes an adjustment point 502, adjuster rod clips 504*a* and 504*b*, adjuster rod 506, lead screw 508, cable carriage 510, translation wheel 512, cable attachment point 514 and retracted left cable 406. Accordingly, in this implementation adjuster rod 506 runs along the longitudinal axis of the upper mount plate 202 having an adjustment point 502 on one end of the rod for rotating the adjuster rod 506 and coupled on the other end of the rod to a lead screw 508 having an outer thread. Adjuster rod clips 504*a* and 504*b* are secured to upper mount plate 202 and allow adjuster rod 506 to rotate while aligning the adjuster rod 506 along the longitudinal axis of upper mount plate 202. Adjustment point 502 is configured to receive torque causing the adjuster rod 506 to rotate clockwise or counterclockwise depending on the design and whether it is desired to extend or retract left cable 108. One implementation couples adjuster rod 506 to lead screw 508 causing both the adjuster rod 506 and lead screw 508 to rotate together.

Further in this implementation, cable carriage 510 includes a cable attachment point 514 on a lower portion for attaching a proximal end of the left cable 108. For example, a loop formed in the proximal end of the cable may looped around a post with a keeper that prevents the loop from escaping. The cable carriage 510 in this implementation of the invention further has a sleeve 516 fixedly attached to an upper portion of the cable carriage 510. The sleeve 516 is slidably attached to lead screw 508 with inner threads corresponding to the outer threads of the lead screw 508. As adjuster rod 506 and lead screw 508 rotate, the lead screw 508 engages sleeve 516 and causes cable carriage 510 and proximal end of the left cable 108 to translate linearly along the longitudinal axis.

First cable adjustment mechanism 402 further includes a translation wheel 512 that rotates about an axis positioned normal to the surface of the upper mount plate 202. In one implementation, the translation wheel 512 has a groove around the perimeter of the wheel configured to receive the left cable 108 as it is extended and retracted. Translation wheel 512 translates between the left cable 108 from running downward and approximately normal to the longitudinal axis of the upper mount to running alongside an approximately parallel to the longitudinal axis. It is contemplated that other means for translating movement of the cable from an approximately normal direction to an approximately longitudinal or parallel direction may also be used instead of translation wheel 512.

Rotary movement of the translation wheel 512 works in cooperation with the cable carriage 510 as it moves along the longitudinal axis of the upper mount plate 202. As the cable carriage 510 moves away from adjustment point 502, the left cable 108 extended below upper mount plate retracts and becomes retracted left cable 406. Indeed, the amount of cable that can be retracted is limited by the overall length of the lead screw 508 as offset by the width of the sleeve 516 or possibly cable carriage 510. In one implementation, approximately eight inches of left cable 108 may be retracted into upper mount plate 202 as retracted left cable 406. Accordingly, the length of the lead screw 508 may also determine the approximate distance the left side of a display device may raised or lowered in accordance with the present invention.

Figure 6:
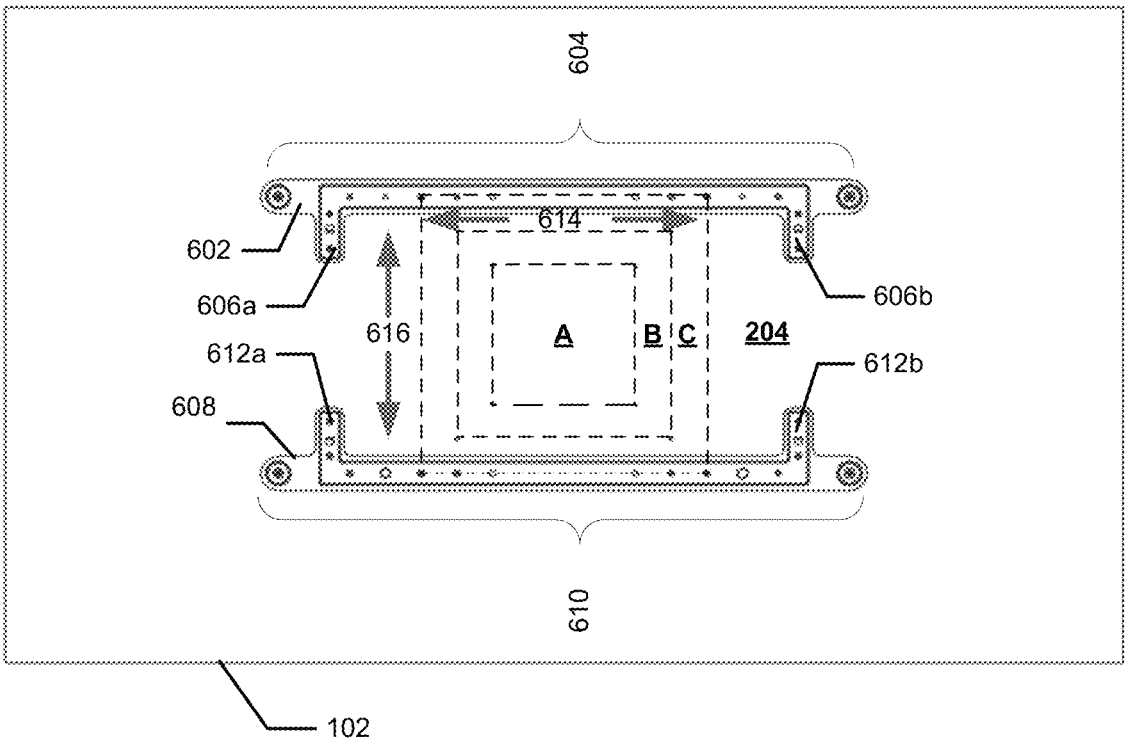
FIG. 6 illustrates a portion of lower mount plate including a first horizontal mount bar and a second horizontal mount bar attached to the back of a display device in accordance with one implementation of the present invention.

FIG. 6 illustrates a portion of lower mount plate 204 attached to the back of a display device 102 in accordance with one implementation of the present invention. This portion of lower mount plate 204 includes a first horizontal mount bar 602 having a predetermined series of selectable holes 604 arranged longitudinally along the bar. The distance between a pair of these selectable holes 604 in the bar may correspond to a horizontal mount hole distance 614 in accordance with a display mount standard. For illustrative purposes, the display device 102 in FIG. 6 is shown with a small mount hole dimension A, a medium mount hole dimension B and a large mount hole dimension C. For example, these mount hole dimensions may correspond to VESA mount dimensions 200 mm×200 mm, 300 mm×300 mm or 400 mm×400 mm having horizontal mount hole distances 200 mm, 300 mm and 400 mm respectively.

The first horizontal mount bar 602 can be fixedly attached through at least two of the selectable holes 604 to the back portion of the display device 102. For example, the two holes used in the first horizontal mount bar 602 may correspond to two upper mounting grommets in the back portion of the display device 102. Mounting grommets may be secured to an internal frame of the display device for added rigidity and strength. In one implementation, the two upper mounting grommets are separated by a horizontal mount hole distance 614 in accordance with VESA mount standards.

Another portion of lower mount plate 204 further includes a second horizontal mount bar 608 also having a predetermined series of selectable holes 610 arranged longitudinally. The distance between a pair of these selectable holes 610 in the second horizontal mount bar 608 may also correspond to a horizontal mount hole distance 614 in accordance with a display mount standard such as VESA. Likewise, the second horizontal mount bar 608 may also be fixedly attached through at least two of the selectable holes 610 to the back portion of the display device 102. Typically, the back portion of the display device also has two lower mounting grommets separated by a horizontal mount hole distance 614 in accordance with VESA mount standards. The second horizontal mount bar 608 is mounted parallel and below the first horizontal mount bar 602 by a vertical mount hole distances 616. The vertical mount hole distance 616 may also be determined based on the vertical space between mount holes specified by a standard such as the VESA mount standard. For example, vertical mount hole distance 616 may include 200 mm, 300 mm or 400 mm respectively corresponding to VESA mount dimensions 200 mm×200 mm, 300 mm×300 mm or 400 mm×400 mm.

Figure 7:
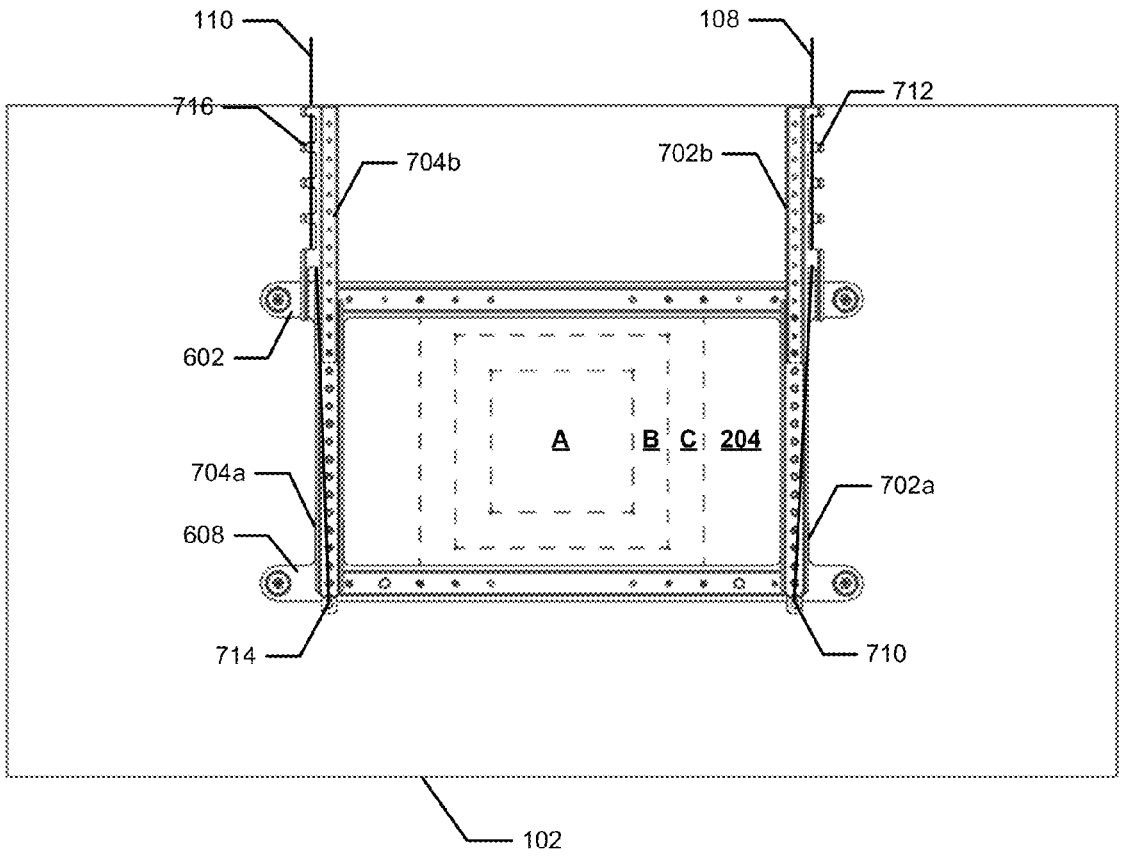
FIG. 7 illustrates a further portion of the lower mount plate of the present invention including a first extensible vertical mount bar and a second extensible vertical mount bar for connecting left cable and right cable to the lower mount plate respectively.

Referring to FIG. 7, a further portion of lower mount plate 204 also includes a first extensible vertical mount bar 702*a/b* and a second extensible vertical mount bar 704*a/b* for connecting left cable 108 and right cable 110 respectively. The first extensible vertical mount bar 702 *a/b* is attached in an approximately normal position to a left portion of the second horizontal mount bar 608 and a left portion of the first horizontal mount bar 602 as exemplified in FIG. 7. The extensible first vertical plate 702*a/b* has a lower pivot hole 710 for inserting the distal end of the left cable 108 and a pivot tab 712 approximately vertically aligned with the lower pivot hole 710. The pivot tab 712 rests against a cable segment below the proximal end of the left cable 108.

The second extensible vertical mount bar 704 *a/b* is attached in an approximately normal position to a right portion of the second horizontal mount bar 608 and a right portion of the first horizontal mount bar 602. The extensible second vertical plate 704*a/b* has a lower pivot hole 714 for inserting the distal end of the right cable 110 and a pivot tab 716 approximately vertically aligned with the lower pivot hole 714. Pivot tab 716 rests against a cable segment below the proximal end of the right cable 110. Together, vertical mount bars 702*a/b* and 704 *a/b* facilitate converting from a conventional mounting standard for display devices such as VESA to a cable-based display hanging system of the present invention.

First extensible vertical mount bar 702*a/b* may be extended from the second horizontal mount bar 608 upwards to the first horizontal mount bar 602 and towards a top horizontal edge of the display device 102. The size of the display and the mount holes may determine how far to extend upper portion 702*b* of first extensible vertical mount bar 702*a/b*. In this example, display device 102 is using large mount hole dimension C and the display is approximately the largest dimension the display hanging system illustrated in FIG. 7 can accommodate. For example, the display device 102 may measure approximately 65" diagonally and use a 400 mm×400 m VESA mount. Accordingly, the lower portion 702*a* of first extensible vertical mount bar 702*a/b* extends from the second horizontal mount bar 608 upwards to the first horizontal mount bar 602. Upper portion 702*b* of second extensible vertical mount bar 702*a/b* extends beyond the first horizontal mount bar 602 up to the top edge of the display device 102.

Similarly, second extensible vertical mount bar 704*a/b* may be extended from the second horizontal mount bar 608 upwards to the first horizontal mount bar 602 and towards a top horizontal edge of the display device 102. Again, the size of the display and the mount holes may determine how far to extend upper portion 704*b* of second extensible vertical mount bar 704*a/b*. Accordingly, the lower portion 704*a* of second extensible vertical mount bar 704*a/b* extends from the second horizontal mount bar 608 upwards to the first horizontal mount bar 602 since the display device in FIG. 7 is using large mount hole dimensions C. Because the display device 120 is the largest the display hanging system in FIG. 7 can accommodate, upper portion 704*b* extends beyond the first horizontal mount bar 602 up to the top edge of the display device 102.

Figure 8:
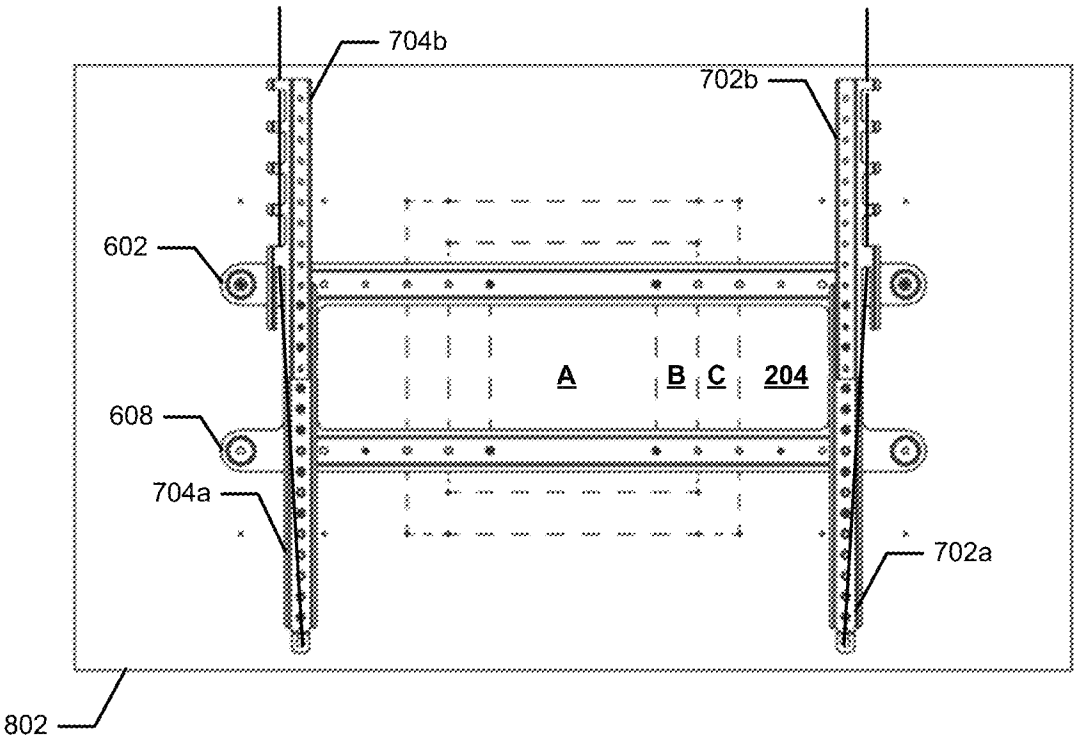
FIG. 8 illustrates configuring the lower mount plate to work with a smaller display device and a smaller mount hole dimension in accordance with another implementation of the present invention.

In contrast FIG. 8 illustrates configuring lower mount plate 204 to work with a smaller display device and a smaller mount hole dimension. In comparison with display device 102 in FIG. 7, it is presumed that example display device 802 has a smaller diagonal dimension and uses the smaller mount hole dimension A. For example, display device 802 in FIG. 8 may measure approximately 48" diagonally and use a 200 mm×200 mm VESA mount. Accordingly, the lower portion 702*a* of second extensible vertical mount bar 704*a/b* extends from below second horizontal mount bar 608 and then upwards to the first horizontal mount bar 602. Likewise, upper portion 702*b* is adjusted lower than first horizontal mount bar 602 and extends up to approximately the top edge of the display device 802. Similarly, the lower portion 704*a* of second extensible vertical mount bar 704*a/b* extends from below second horizontal mount bar 608 upwards to the first horizontal mount bar 602 since the display device in FIG. 8 is using smaller mount hole dimension A. Because the display device 802 in FIG. 8 has smaller a diagonal dimension than display device 102, the upper portion 704*b* also is adjusted to be lower than first horizontal mount bar 602 and extends up to approximately the top edge of display device 802.

Figure 9:
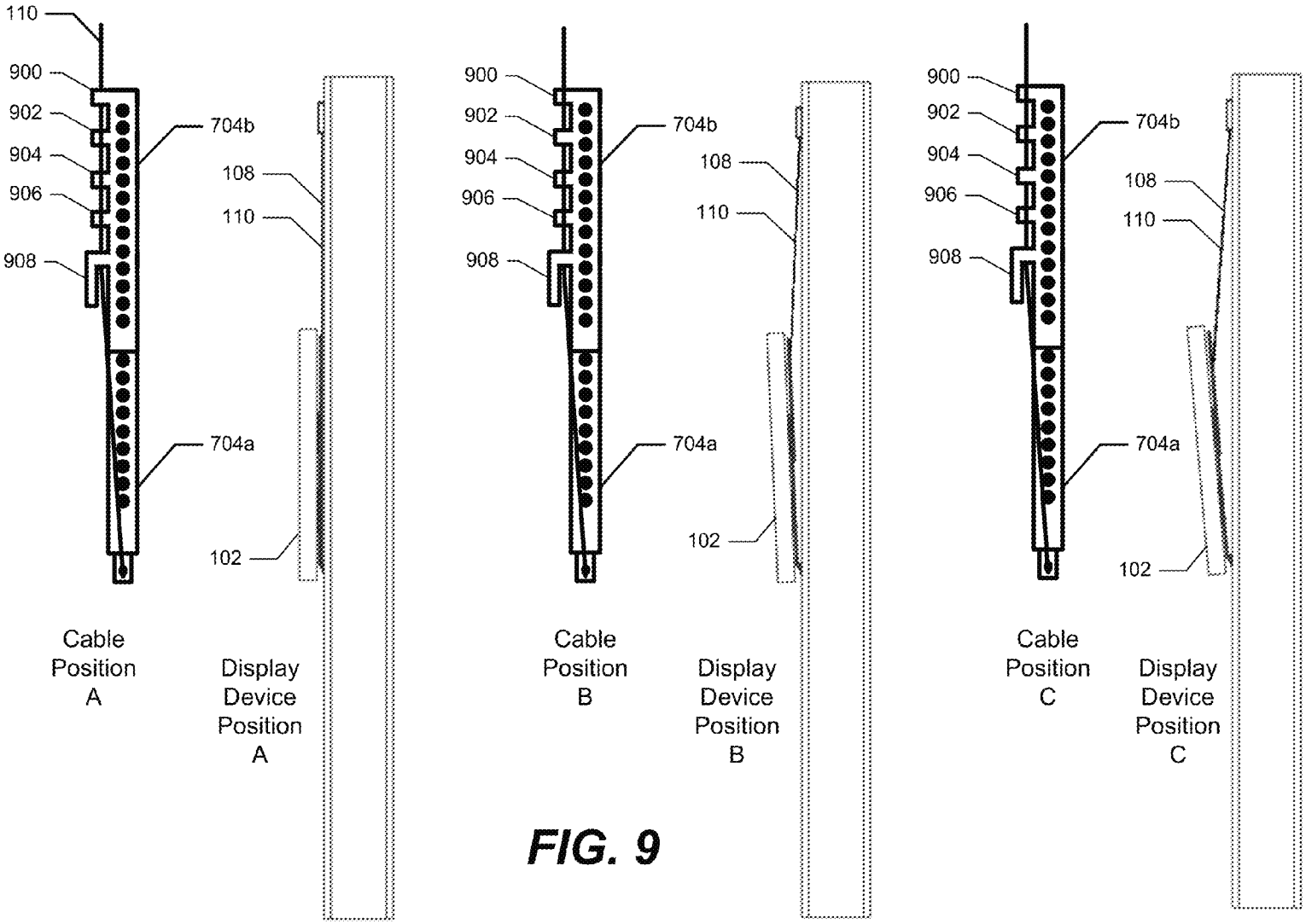
FIG. 9 illustrates using various cable positions to modify the position of the display device in accordance with aspects of the present invention.

FIG. 9 illustrates using various cable positions to modify the position of the display device in accordance with aspects of the present invention. In particular, a change in the cable position on the first extensible vertical mount bar 702*a/b* and second extensible vertical mount bar 704*a/b* may be used to keep a display device in either a more upright position or a more tilted position. To illustrate this effect schematically, FIG. 9 illustrates a second extensible vertical mount bar 704*a/b* as representative of the cable positioning to be used for both first extensible vertical mount bar 702*a/b* (not shown in FIG. 9) and second extensible vertical mount bar 704*a/b*; a display device position side view is also included to demonstrate how the cable position changes the position of a display device in accordance with the present invention.

Accordingly, one implementation of second extensible vertical mount bar 704*a/b* includes a higher pivot tab 900, a pivot tab 902, a lower pivot tab 904, a lowest pivot tab 906 and a safety tab 908. First extensible vertical mount bar 702*a/b* (not shown in FIG. 9) also includes a higher pivot tab 900, a pivot tab 902, a lower pivot tab 904, a lowest pivot tab 906 and a safety tab 908. In cable position A, right cable 110 keeps the display device positioned in a more upright position because the higher pivot tab 900 on the second extensible vertical mount bar 704*a/b* rests against the segment of cable below the proximal end of right cable 110. Consequently, display device position A shows a display device 102 in a relatively upright position when the left cable 108 and right cable 110 are routed in front of the higher pivot tab 900 on both the first extensible vertical mount bar 702*a/b* and second extensible vertical mount bar 704*a/b*.

Referring to cable position B, right cable 110 keeps the display device positioned in a less upright or tilted position because the pivot tab 902 on the second extensible vertical mount bar 704*a/b* rests against the segment of cable below the proximal end of right cable 110. Consequently, display device position A shows a display device 102 in the less upright or tilted position when the left cable 108 and right cable 110 are routed in front of the pivot tab 902 on both the first extensible vertical mount bar 702*a/b* and second extensible vertical mount bar 704*a/b*.

Referring to cable position C, right cable 110 keeps the display device positioned with a greater angle of tilt because the lower pivot tab 904 on the second extensible vertical mount bar 704*a/b* rests against the segment of cable below the proximal end of right cable 110. Consequently, display device position A shows a display device 102 positioned with an even greater angle of tilt when both the left cable 108 and right cable 110 are routed in front of the lower pivot tab 904 on both the first extensible vertical mount bar 702*a/b* and second extensible vertical mount bar 704*a/b*.

It should be appreciated that a display device 102 may be positioned with a greater angle of tilt than display device position C when both the left cable 108 and right cable 110 are routed in front of the lowest pivot tab 906 on both the first extensible vertical mount bar 702*a/b* and second extensible vertical mount bar 704*a/b*. Moreover, the amount of tilt may be increased or decreased depending on whether right cable 110 and left cable 108 are in a fully extended or fully retracted position. For example, more tilt may be achieved when fully extending right cable 110 and left cable 108 and using lower pivot tab 904 on both the first extensible vertical mount bar 702*a/b* and second extensible vertical mount bar 704*a/b*. Safety tab 908 is designed to ensure display device 102 does not accidentally disengage from both first extensible vertical mount bar 702*a/b* and second extensible vertical mount bar 704*a/b* when the display device position is being adjusted.

While specific embodiments have been described herein for purposes of illustration, various modifications may be made without departing from the spirit and scope of the invention. Accordingly, the invention is not limited to the above-described implementations, but instead is defined by the appended claims in light of their full scope of equivalents.

What is claimed is:

1. An apparatus for hanging a display device, comprising:

an upper mount plate suitable for attaching to a flat surface having a left cable extending downward and approximately normal to a longitudinal axis of the upper mount plate and a right cable extending downward and approximately normal to the longitudinal axis of the upper mount plate;

a first cable adjustment mechanism integrated into the upper mount plate that changes the length of the left cable extended downward from the upper mount plate and a second cable adjustment mechanism integrated into the upper mount plate that changes the length of the right cable extended downward from the upper mount plate, wherein the first cable adjustment mechanism and the second cable adjustment mechanism each further includes an adjuster rod running along the longitudinal axis of the upper mount plate having an adjustment point on one end of the rod for rotating the adjustment rod and coupled on the other end of the rod to a lead screw having an outer thread, wherein the adjuster rod and lead screw rotate together;

a first cable carriage associated with the first cable adjustment mechanism and a second cable carriage associated with the second cable adjustment mechanism, each cable carriage having a cable attachment point on a lower portion for attaching a proximal end of a cable and a sleeve with inner threads corresponding to the outer threads of the lead screw on an upper portion of the cable carriage, the sleeve slidably attached to the lead screw causing the cable carriage and proximal end of either the cable to translate linearly along a longitudinal axis of the lead screw as the lead screw rotates;

a first translation wheel associated with the first cable carriage and a second translation wheel associated with the second cable carriage, each translation wheel designed to rotate about an axis positioned normal to the surface of the upper mount plate and having a groove around the perimeter of the wheel configured to receive a cable and translate between the cable running downward and approximately normal to the longitudinal axis of the upper mount and the cable running along the longitudinal axis in cooperation with a cable carriage also moving along the longitudinal axis of the upper mount plate; and a lower mount plate attachable to a back portion of a display device having at least two vertically aligned receiving points for the left cable on a left portion of the lower mount plate and at least two vertically aligned receiving points for the right cable on a right portion of the lower mount plate.

2. The apparatus of claim 1 wherein the lower mount plate further comprises:

a first horizontal mount bar having a predetermined series of selectable holes arranged longitudinally along the first horizontal mount bar, the first horizontal bar to be fixedly attached through at least two of the selectable holes of the first horizontal bar to the back portion of the display device and a corresponding at least two upper mounting grommets in the back portion of the display and separated by a horizontal mount hole distance;

a second horizontal mount bar also having a predetermined series of selectable holes arranged longitudinally along the second horizontal mount bar, the second horizontal mount bar to be fixedly attached through at least two of the selectable holes of the second horizontal mount bar to the back portion of the display device and a corresponding at least two lower mounting grommets in the back portion of the display and separated by a horizontal mount hole distance, wherein the second horizontal mount bar to be fixedly attached parallel and below the first horizontal mount bar by a vertical mount hole distance through at least two of the selectable holes of the second horizontal plate to the back portion of the display device, the at least two of the selectable holes of the bottom horizontal plate correspond to at least two lower mounting grommets in the back portion of the display disposed below the upper mounting grommets by the vertical mount hole distance;

a first extensible vertical mount bar capable of extending from the second horizontal mount bar upwards to the first horizontal mount bar and towards a top horizontal edge of the display device, the first extensible vertical mount bar is fixedly attached in an approximately normal position to a left portion of the second horizontal mount bar and a left portion of the first horizontal mount bar, the extensible first vertical plate having a first lower pivot hole for inserting the distal end of the left cable and a first upper pivot tab vertically aligned with the first lower pivot hole that rests against a segment of cable below the proximal end of the left cable; and a second extensible vertical mount bar capable of extending from the second horizontal mount bar upwards to the first horizontal mount bar and towards a top horizontal edge of the display device, the second extensible vertical mount bar fixedly attached in an approximately normal position to a right portion of the second horizontal mount bar and a right portion of the first horizontal mount bar, the second extensible vertical mount bar having a second lower pivot hole for inserting the distal end of the right cable and a second upper pivot tab vertically aligned with the second lower pivot hole that rests against a segment of cable below the proximal end of the right cable.

3. The apparatus of claim 2, wherein the vertical plate further comprises:

a first higher pivot tab located above the first pivot tab on the first extensible vertical mount bar and second higher pivot tab located above the second pivot tab on the second extensible vertical mount bar that allows the display device to be positioned in a more upright position when the first higher pivot tab on the first extensible vertical mount bar rests against a segment of cable below the proximal end of the right cable and the second higher pivot tab on the second extensible vertical mount bar rests against a segment of cable below the proximal end of the left cable; and a first lower pivot tab located below the first pivot tab on the first extensible vertical mount bar and a second lower pivot tab located below the second pivot tab on the second extensible vertical mount bar that allows the display device to be positioned with a greater angle of tilt around the first and second lower pivot holes when the first lower pivot tab on the first extensible vertical mount bar rests against the segment of cable below the proximal end of the right cable and the second lower pivot tab on the second extensible vertical mount bar rests against the segment of the cable below the proximal end of the left cable.

* * * * *